US008734057B2

(12) United States Patent
Jung et al.

(10) Patent No.: US 8,734,057 B2
(45) Date of Patent: May 27, 2014

(54) METHOD OF AND SYSTEM FOR INSTALLING FOUNDATION ELEMENTS IN AN UNDERWATER GROUND FORMATION

(75) Inventors: Boudewijn Casper Jung, Bergen op Zoom (NL); Jan Albert Westerbeek, Spijkenisse (NL)

(73) Assignee: IHC Holland IE B.V., Sliedrecht (NL)

( * ) Notice: Subject to any disclaimer, the term of this patent is extended or adjusted under 35 U.S.C. 154(b) by 212 days.

(21) Appl. No.: 13/155,396

(22) Filed: Jun. 8, 2011

(65) Prior Publication Data

US 2011/0299938 A1 Dec. 8, 2011

(30) Foreign Application Priority Data

Jun. 8, 2010 (EP) ..... 10165298

(51) Int. Cl.
*E02D 13/00* (2006.01)

(52) U.S. Cl.
USPC ..... 405/228; 405/232; 175/10; 173/1

(58) Field of Classification Search
USPC ..... 405/228, 231, 232, 229; 175/10; 173/1, 173/91
See application file for complete search history.

(56) References Cited

U.S. PATENT DOCUMENTS

| | | | | |
|---|---|---|---|---|
| 822,620 | A * | 6/1906 | Mayo | 175/10 |
| 2,583,965 | A * | 1/1952 | Page, Jr. et al. | 175/6 |
| 4,856,938 | A * | 8/1989 | Kuehn | 405/227 |
| 4,989,677 | A * | 2/1991 | Lam | 173/31 |

FOREIGN PATENT DOCUMENTS

| | | | |
|---|---|---|---|
| DE | 1784396 | | 7/1971 |
| JP | 51104605 | U | 8/1976 |
| JP | 53019305 | U | 2/1978 |
| JP | 54133604 | U | 9/1979 |
| JP | 58050142 | U | 4/1983 |
| JP | 59080535 | U | 5/1984 |
| JP | H0340331 | U | 4/1991 |

OTHER PUBLICATIONS

European Search Report, mailed Dec. 1, 2010 in connection with European Patent Application No. 10165298.0.
Translation of abstract JP 61246422 A, Publication date: Nov. 1986.
Article: T.J. Carlson et al., Hydroacoustic Measurements During Pile Driving at the Hood Canal Bridge, Sep. Through Nov. 2004, Publication date: Nov. 2005.
Translation of abstract JP60159218 (A), Publication date: Aug. 1985.
Translation of abstract JP 10292373 A, Publication date: Nov. 1998.

* cited by examiner

*Primary Examiner* — Sean Andrish
(74) *Attorney, Agent, or Firm* — Steven M. Koehler; Westman, Champlin & Koehler, P.A.

(57) ABSTRACT

The invention relates to a method of installing foundation elements, in particular (mono)piles (2), in an underwater ground formation (3), by means of a driver (4), comprising the steps of placing a foundation element (2) on the underwater ground formation (3) and holding the foundation element (2) in place by means of a gripper (10) mounted on a surface vessel, placing a sleeve (6) for reducing noise input from the driver (4) about the foundation element (2), disengaging the gripper (10), lowering the sleeve (6) onto the ground formation (3), and placing the driver (4) on top of the foundation element (2). The sleeve (6) is held at least laterally with a guide (11) mounted on the surface vessel, at least when disengaging the gripper (10).

17 Claims, 3 Drawing Sheets

METHOD OF AND SYSTEM FOR INSTALLING FOUNDATION ELEMENTS IN AN UNDERWATER GROUND FORMATION

CROSS-REFERENCE AND PRIORITY CLAIM TO RELATED APPLICATIONS

This application claims priority to European Patent Application No. 10165298.0, filed Jun. 8, 2010, entitled "Method of and system for installing foundation elements in an underwater ground formation" which application is incorporated herein by reference and made a part hereof in its entirety.

SUMMARY

The invention relates to a method of installing foundation elements, in particular (mono)piles, in an underwater ground formation by means of a driver, such as an hydraulic driver. The method comprises the steps of placing a foundation element on the underwater ground formation and holding the foundation element in place by means of a gripper mounted on a surface vessel. A sound-insulating sleeve for reducing noise input from the driver into surrounding water is placed about the foundation element and lowered onto the ground formation. Subsequently, the driver is placed on top of the foundation element and the foundation element is driven to an appropriate depth.

As explained in European patent publication 1 989 358, offshore ramming work is carried out under water to establish foundations, for example, for drilling platforms and wind turbines. For wind turbines, large monopiles with a diameter of more than four meters are rammed into the seabed. This ramming results in a substantial underwater noise input, which can have a negative impact on marine fauna. To reduce the noise input underwater, in the method and device according to EP 1 989 358, the material that is to be rammed is surrounded by a fixed flooded sleeve. The sleeve advantageously has a sandwich-like structure. In the example shown in FIG. 1 of EP 1 989 358, the sleeve has at least one damping guide element for guiding a pile.

T. J. Carlson et al., "Hydroacoustic Measurements During Pile Driving at the Hood Canal Bridge, September Through November 2004" discloses a HDPE pipe sleeve that fits over a 24 inch pile and reaches from a point above water to the ground elevation below water. The mentioned sleeve diameter and wall thickness are 34 inch and 1⅜ inch, respectively.

In the method described in the opening paragraph, the sleeve cannot be lowered onto the seabed without first disengaging the gripper. Disengaging the gripper leaves the foundation element unsupported, which implies a risk especially in stronger currents or with large foundation elements, such as monopiles having a diameter of four meters or more and a length of fifty meters or more.

It is an object of the present invention to provide a method and system that include a sleeve for reducing the noise input generated by the driver and yet allow support of the foundation element during installation, in particular during the placing of the sleeve and preferably also during the driving of the foundation element into the seabed.

To this end, the method according to the present invention is characterized by at least laterally holding the sleeve with a guide mounted on the surface vessel, at least when disengaging the gripper. In an embodiment, the foundation element is held in place by the sleeve. Thus, an interruption of supporting the foundation element during the placing of the sleeve is avoided.

In an embodiment, the sleeve is lowered along the foundation element and onto the ground formation while held inside the guide, i.e. the guide supports the sleeve also during lowering.

In a further embodiment, to further increase stability, the foundation element, before the sleeve is placed and/or the first gripper is disengaged, is driven into the ground formation over a relatively short distance, e.g. less than twice the diameter of the foundation element, by means of the driver. In such embodiments, the driver is preferably operated at less than 20% of its maximum impact energy.

The invention further relates to a system for installing foundation elements, in particular (mono)piles, in an underwater ground formation, comprising a driver, a surface vessel, a gripper for holding the foundation element in place, which gripper is mounted on the surface vessel, and a sleeve to be placed about the foundation element and, during the driving of the foundation element, on the ground formation to reduce noise input from the driver. The system further comprises a guide mounted on the surface vessel for at least laterally holding the sleeve.

In an embodiment, the sleeve comprises one or more guide elements on its inner wall, which elements, to reduce transmission of noise from the driver to the sleeve, preferably comprise a noise damping material, such as rubber.

To improve guiding, especially during lowering the sleeve and driving the foundation element, it is preferred that guide elements are located at least near the bottom of the sleeve and in its upper half.

In a further embodiment, to adapt the system to foundation elements and sleeves of different diameters, the effective inner diameter of the guide for the sleeve and/or the guide elements inside the sleeve is adjustable. E.g., parts of the guide and/or the guide elements are extendable in radial direction or interchangeable with parts or elements of a different size.

For the sake of completeness, attention is drawn to the following documents.

JP 60-159218 discloses a sound insulator for a pile hammer comprising sound insulating cylinders, which are formed from a resilient material and in the shape of bellows. The sound insulating cylinders are secured around a pile.

DE 1 784 396 discloses a pile driving hammer comprising a telescopic sound absorbing sleeve.

The invention will now be explained in more detail with reference to the Figures, which show a preferred embodiment of the present method and system.

It is noted that the Figures are schematic in nature and that details, which are not necessary for understanding the present invention, may have been omitted.

DETAILED DESCRIPTION

Figure 1:
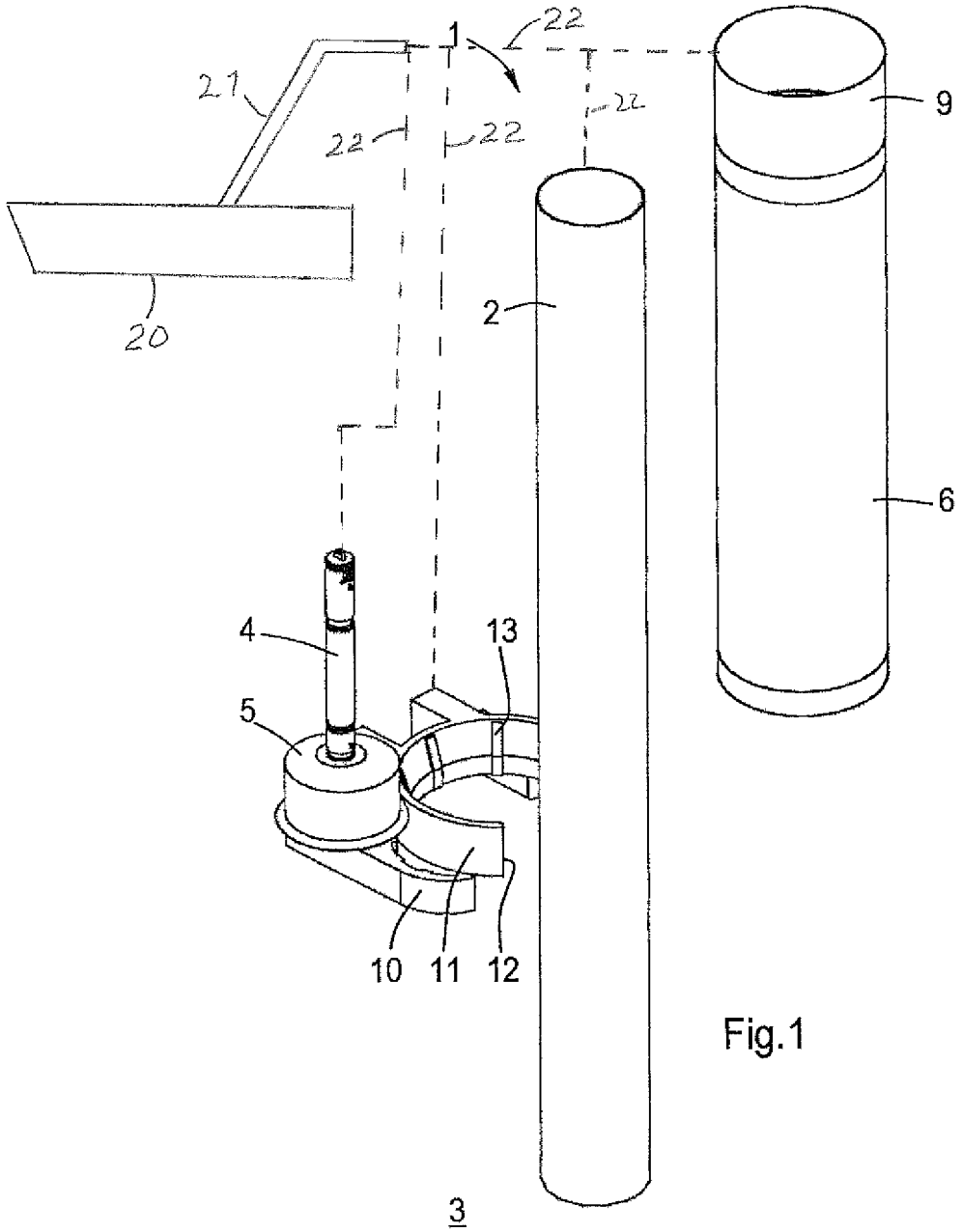
FIG. 1 is a schematic view of a system for installing a foundation element into an underwater ground formation.

FIG. 1 shows an embodiment of the system 1 according to the present invention for installing a monopile 2 in an underwater ground formation 3, e.g. a seabed. In this example, the monopile 2 has a circular cross-section and a diameter of five (5) meters and is intended to serve, after installation, as the foundation of a wind turbine.

The system 1 comprises an hydraulic driver 4, e.g. an IHC Hydrohammer S-1800, connected to a power pack on board of a surface vessel, such as a jack-up barge (not shown), a driver sleeve 5 for securely mounting the driver on the monopile and an anvil (hidden from view by the driver sleeve) for transmitting impact energy from the driver 4 to the monopile.

The system further comprises a sound-insulating sleeve 6, made of e.g. steel, to be placed about the foundation element and on the ground formation to reduce noise input from the driver into the surrounding water. In this example, the sleeve is double walled, has a circular cross-section and an inner diameter of six meters. The double wall provides one or more chambers 7 (FIG. 6) for air or a porous material and renders the sleeve buoyant. In general, to reduce or substantially avoid excessive penetration of the sleeve into the seabed under its own weight, it is preferred that buoyancy, i.e. the weight of the displaced water, is at least 60% preferably at least 80% of the weight of the sleeve in the system according to the present invention.

Figure 6:
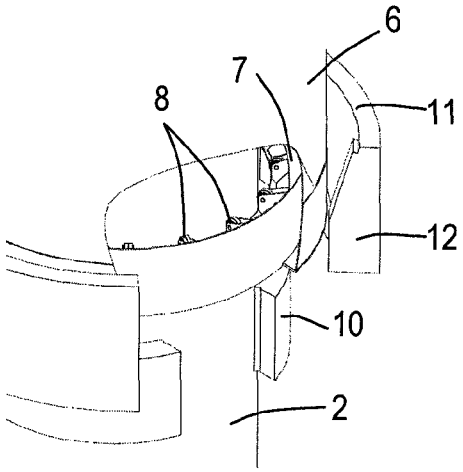
FIG. 6 is a schematic cut away showing more detail of the guide support engaging the sleeve.

The inner wall of the sleeve 6 is provided with a plurality of guide elements, in this example two sets of guide wheels 8 made of a noise damping material, such as rubber, and arranged in a ring along the (inner) circumference of the sleeve, both near its bottom, as shown in detail in FIG. 6, and somewhere in its upper half, in this example at a few meters from it upper rim. Separating the sets of guide elements in the axial direction provides a substantial guiding length and thus further increases stability.

The upper rim of the sleeve is provided with a detachable extender 9, which is used to adjust the effective length of sleeve to the depth of the water at the location where the foundation element is to be installed. In general, it preferred that, once in place, the sound-insulating sleeve extends from the ground formation to above the water level.

The jack-up barge 20 comprises a crane 21 to lift and manipulate the monopile 2 and the sleeve 6, a gripper 10 to hold the monopile 2 in a selected orientation, typically vertically, and a guide 11 for the sleeve 6. The guide 11 is 5 ring-shaped and comprises a side opening 12 for laterally receiving the monopile 2. At least the upper part of the inner wall of the guide 11 diverges upwards to centre the sleeve 6 when it is lowered into the guide 11. In this example, the inner wall of the guide 11 comprises guide 10 blocks 13 of a low friction material, such as a polyethylene, e.g. UHMPE.

Figure 2:
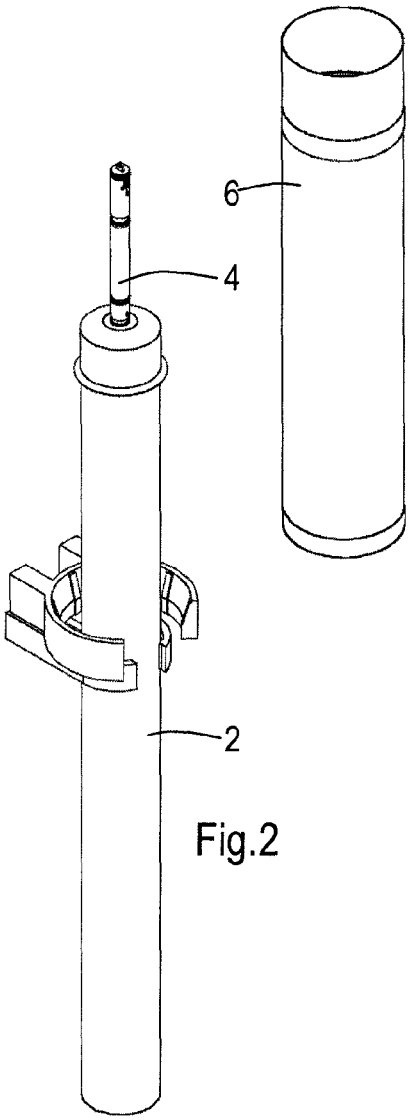
FIG. 2 is a schematic illustration of a driver secured to a top end of a foundation element and a gripper secured to the foundation element along with a sleeve disengaged from the foundation element utilized in a first method for installing the foundation element.

Installation of a monopile is carried out for instance as follows. A monopile with its ends closed by caps to enabled it to float is towed to a position within reach 15 of the crane. One of the caps is removed, thus flooding and raising the monopile to an upright position. The cables 22 of the crane 21 are attached to the upper end of the monopile and the monopile is manipulated to a position inside the open gripper. The monopile is lowered onto the seabed and, if 20 required by the circumstances, allowed to penetrate the seabed under its own weight. The gripper is closed and the cables of the crane are released and attached to the top or the side(s) of the sleeve, which may at that point in time be placed on deck or in the sea. The guide is extended from 25 the barge 28 and positioned about the monopile and the driver is mounted on top of the pile, as shown in FIG. 2.

Figure 3:
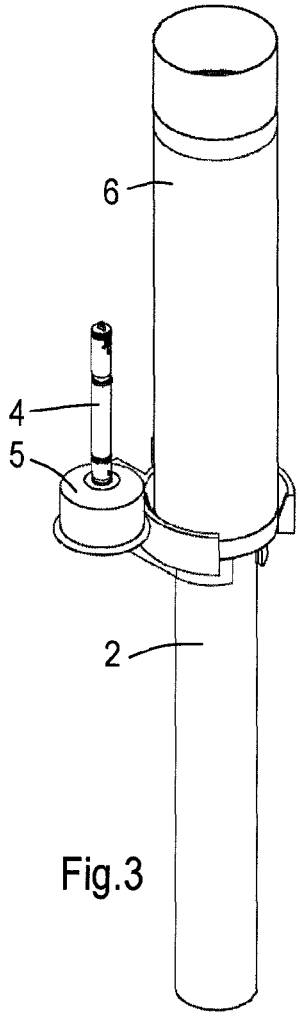
FIG. 3 is a schematic illustration of a gripper element secured to a foundation element and the sleeve positioned about a foundation element and engaging a guide support utilized in another method for installing the foundation element.

At this stage, the monopile is driven into the seabed to a depth of approximately ten meters to further stabilize the monopile. To avoid excessive noise input into the surrounding water, during this stage, the driver is operated at 10% of its maximum impact energy, which usually is sufficient for the first few meters of penetration. The sleeve is lifted over the monopile and the driver on top of the monopile and lowered onto the guide. Alternatively, as shown in FIG. 3, the sleeve is lifted and lowered in the guide first and the driver is subsequently placed inside the sleeve and on top of the pile.

During these steps, the foundation element is held in place by means of the gripper and remains sufficiently stable to withstand strong currents in the water and prevent keeling over e.g. as a result of further and uncontrolled penetration.

With the driver mounted on top of the foundation element, the sleeve secured inside the guide, and the monopile secured 10 inside the sleeve, the gripper is disengaged and the sleeve is lowered into the water and onto the seabed with the bulkhead extending 1 to 5 meter above sea level.

Figure 4:
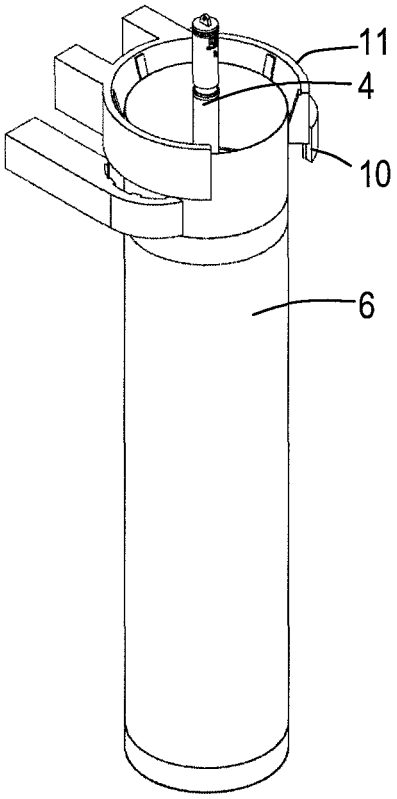
FIG. 4 is a schematic illustration of a driver secured to a top end of the foundation element and the sleeve retained within the guide element with the gripping element disengaged from the sleeve and the foundation element utilized in the first method for installing the foundation element.
Figure 5:
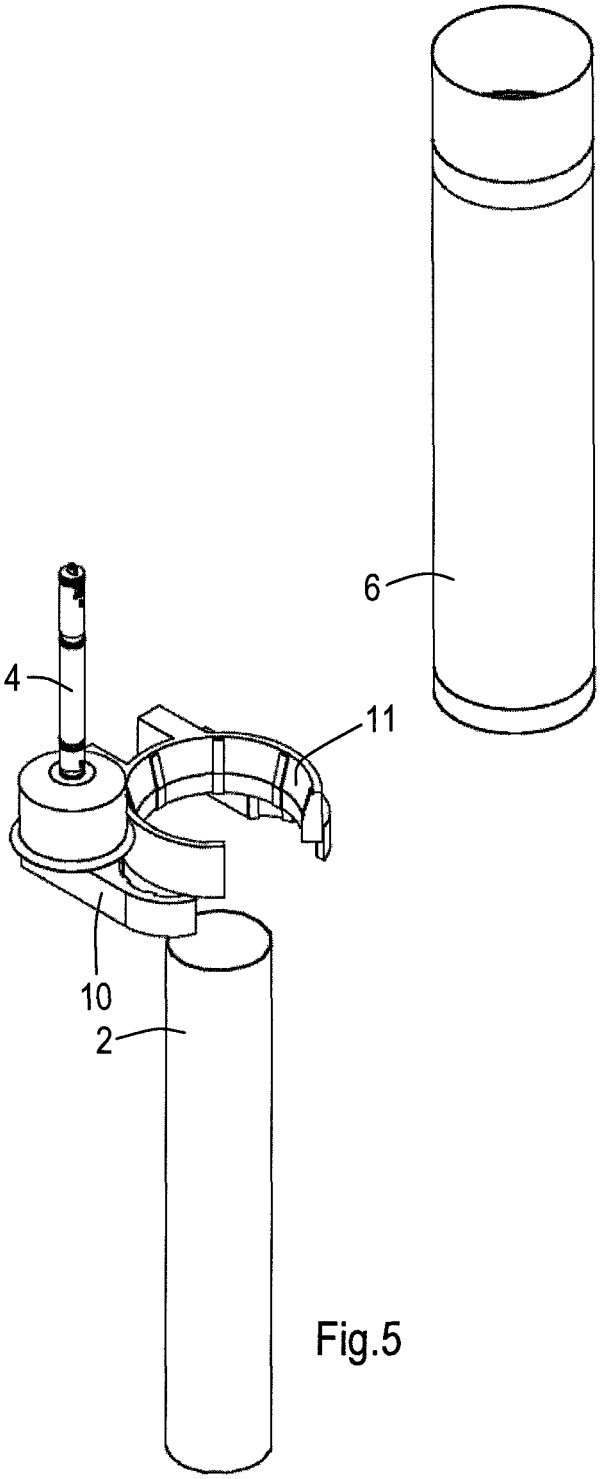
FIG. 5 is a schematic illustration of the sleeve, gripping element and guide support detached from a foundation element secured within an underwater ground structure utilized in the first method for installing the foundation element.

Subsequently, the monopile is driven into the seabed to the desired depth, see FIG. 4. During driving, 15 the sleeve completely surrounds the monopile, reducing noise input into the surrounding water. Water can then be removed from the sleeve such that during at least part of the driving, at least the driver is separate from the inner wall of the inner wall of the foundation element by air.

Finally, the driver is removed, the sleeve lifted through the guide and placed back on deck or into the sea, and installation is completed.

In this example, the monopile is continuously held from the moment it is secured by the gripper to the completion of its installation. In particular, an interruption of the stable position of the monopile during the placing of the sound-insulating sleeve is avoided.

The invention is not restricted to the embodiment described above and can be varied in numerous ways within the scope of the claims.

The invention claimed is:

1. A method of installing foundation elements in an underwater ground formation, by means of a driver, comprising:

placing a foundation element in a selected location on the underwater ground formation and holding the foundation element in the selected location with a gripper supported by a surface vessel, placing a sleeve for reducing noise input from the driver about the foundation element, disengaging the gripper, lowering the sleeve onto the ground formation, placing the driver on top of the foundation element, and at least laterally holding the sleeve with a guide supported by the surface vessel, at least when disengaging the gripper.

2. The method according to claim 1, wherein the foundation element is retained in the selected location by the sleeve.

3. The method according to claim 1, wherein the sleeve is lowered while held inside the guide.

4. The method according to claim 1, wherein the guide is placed laterally about the foundation element, before at least one of the guide and the foundation element is engaged by the sleeve.

5. The method according to claim 1, wherein the foundation element, before at least one of the sleeve is placed about the foundation element and the gripper is disengaged, is driven into the ground formation over a short distance with the driver.

6. The method according to claim 1, wherein the foundation element is driven into the ground formation at less than 20% of a maximum impact energy of the driver.

7. The method according to claim 1, wherein water is removed from the sleeve such that, at least during part of driving, at least the driver is separated from the inner wall of the foundation element by air.

8. The method according to claim 1, wherein the guide is located above the gripper.

9. A system for installing foundation elements in an underwater ground formation, comprising a driver, a surface vessel supporting the driver, a gripper configured to hold the foundation element in a selected position and supported by the surface vessel, and a sleeve configured to be placed about the foundation element and on the ground formation to reduce noise input from the driver during driving of the foundation element, and a guide supported by the surface vessel and configured to at least laterally hold the sleeve.

10. The system according to claim 9, wherein the sleeve comprises one or more guide elements on an inner wall of the sleeve.

11. The system according to claim 10, wherein the one or more guide elements comprise a noise damping material.

12. The system according to claim 10, comprising at least one guide element located at least near a bottom of the sleeve and at least one guide element located in an upper half of the sleeve.

13. The system according to claim 9, wherein the effective inner diameter of the guide for at least one of the sleeve and one or more guide elements inside the sleeve is adjustable.

14. The system according to claim 9, wherein the guide is substantially ring-shaped and comprises an opening configured for laterally receiving the foundation element.

15. The system according to claim 9, comprising an extender detachably coupled to the sleeve, the extender being configured to adjust an effective length of the sleeve.

16. The system according to claim 9, wherein the sleeve comprises one or more chambers that render the sleeve buoyant.

17. A system for installing foundation elements in an underwater ground formation utilizing a surface vessel, the system comprising:

a driver configured to be supported by the surface vessel;

a gripper configured to hold the foundation element in a selected position and configured to be supported by the surface vessel, a sleeve configured to be placed about the foundation element and on the ground formation to reduce noise input from the driver; and a guide supported by the floating vessel and configured to at least laterally hold the sleeve.

* * * * *